US005226872A

United States Patent [19]

Watson

[11] Patent Number: 5,226,872

[45] Date of Patent: Jul. 13, 1993

[54] SHEET FOLDING DEVICE

[76] Inventor: Graham Watson, 50 Hildyard Close, Hardwicke, Gloucester GL2 6PZ, England

[21] Appl. No.: 865,243

[22] Filed: Apr. 8, 1992

[30] Foreign Application Priority Data

Apr. 8, 1991 [GB] United Kingdom ..... 9107380

[51] Int. Cl.[5] ..... B65H 45/20; B65H 45/04

[52] U.S. Cl. ..... 493/457; 493/405; 493/451

[58] Field of Search ..... 493/405, 413, 433, 448, 493/451, 454, 455, 457

[56] References Cited

U.S. PATENT DOCUMENTS

| | | | |
|---|---|---|---|
| 13,543 | 9/1855 | Elliot | 493/457 |
| 141,742 | 8/1873 | Washburn | 493/[illegible] |
| 747,085 | 12/1903 | Rieffel | 493/[illegible] |
| 1,245,421 | 11/1917 | Amberg | 493/457 |
| 1,809,000 | 6/1931 | Stealy | 493/405 |
| 3,229,974 | 1/1966 | Banks | 493/433 |
| 3,279,784 | 10/1966 | Schwendinger | 493/413 |
| 3,481,595 | 12/1969 | Stuart | 63/284.3 |
| 3,759,507 | 9/1973 | Imbrecht | 493/413 |
| 4,265,439 | 5/1981 | Sundberg | 493/451 |
| 4,597,748 | 7/1986 | Wolf | 493/413 |

FOREIGN PATENT DOCUMENTS

| | | | |
|---|---|---|---|
| 1284132 | 6/1962 | France | 493/448 |
| 1487066 | 6/1967 | France | 493/448 |

*Primary Examiner*—William E. Terrell

*Attorney, Agent, or Firm*—Young & Thompson

[57] ABSTRACT

A folding device for folding a sheet of thin material, such as paper, comprises a first sheet holder for holding a first portion of the sheet, a second sheet holder for holding a second portion of the sheet, and a pivoted linkage connecting the first sheet holder to the second sheet holder in such a way as to allow relative movement between them. In use relative movement between the holders causes the sheet to be folded in opposite directions along two lines so as to form a zig-zag shape.

7 Claims, 1 Drawing Sheet

SHEET FOLDING DEVICE

BACKGROUND OF THE INVENTION

The present invention relates to a folding device for folding a sheet of thin material such as paper.

The folding of a sheet of paper is a common task performed by many people, especially in order to fit a letter into an envelope. Frequently, the relative sizes of the envelope and the paper mean that the paper must be folded at least twice in order to be placed into the envelope.

SUMMARY OF THE INVENTION

According to the invention there is provided a folding device for folding a sheet of thin material, such as paper, comprising a first sheet holder for holding a first portion of the sheet, a second sheet holder for holding a second portion of the sheet, and connection means connecting the first sheet holder to the second sheet holder in such a way as to allow relative movement between the first and second sheet holders, said relative movement being such as to cause the sheet to be folded in opposite directions along two lines so that, when folded, the sheet forms a zig-zag shape.

The folding device may be arranged so that said relative movement causes the folds along said two lines to be formed substantially simultaneously.

In order to allow the sheet to be folded in different manners, the distance between the two sheet holders may be adjustable.

Preferably, each sheet holder comprises two parallel holding members defining between them an elongate slot adapted to receive a respective portion of the sheet, and the connection means is arranged to ensure that the two elongate slots extend along substantially parallel axes throughout said relative movement.

The two holding members of at least one of the sheet holders may be movable relative to one another in order to allow the sheet to be more easily inserted between them prior to folding. The two holding members might, for example, be pivotally connected together, and/or one of the holding members might be telescopic. It should be understood that the two holding members of each sheet holder are referred to above as being parallel because they are parallel during the folding operation, i.e. during said relative movement.

The width of at least one of the slots may be adjustable, and at least one of the sheet holders may be adapted to clamp the sheet within its respective slot.

The folding device may be provided with guide means for guiding the sheet into at least one of said slots before the sheet is folded.

The folding device may further comprise at least one stop for enabling the sheet to be correctly positioned relative to the sheet holders before it is folded.

Preferably, the connection means enables the first sheet holder to be moved through substantially 180° relative to the position of the second sheet holder, and thus to be moved from one side of the second sheet holder to the opposite side of the second sheet holder.

In this case, said relative movement may be along a circular path, but need not necessarily be so.

Conveniently, at least one of the holding members of each sheet holder is provided with a substantially flat and planar sheet bearing surface, and the connection means is adapted to ensure that said sheet bearing surfaces remain substantially parallel with one another throughout said relative movement.

In one embodiment of the invention, the connection means is formed as a parallel four-bar linkage.

The folding device may be provided with a handle for enabling said relative movement to be effected manually.

Alternatively, said relative movement may be effected by a motor.

DETAILED DESCRIPTION OF THE PREFERRED EMBODIMENT

Figure 1:
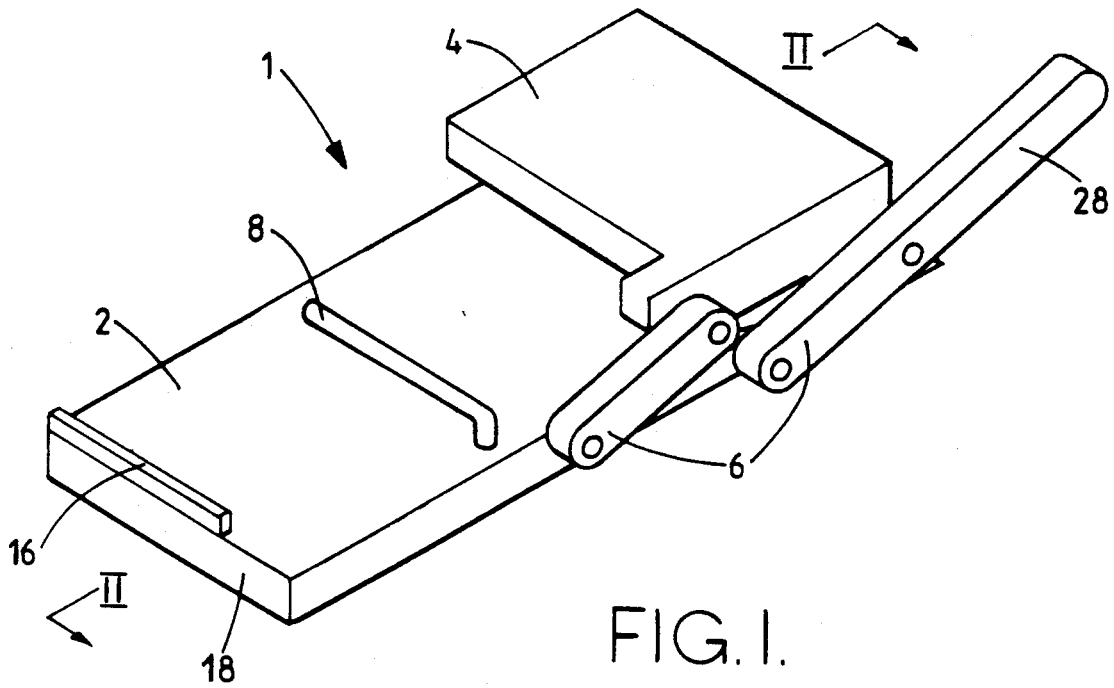
FIG. 1 is a perspective view of a desk top folding device.

The folding device 1 comprises an elongate flat base part 2 connected at one side thereof to a flat upper part 4 by means of a four-bar linkage 6. The four-bar linkage 6 enables the upper part 4 to be moved between a first position in which it lies flatly above one end of the base part 2, and a second position in which lies flatly above the other end of the base part 2. The first and second positions are shown respectively in FIGS. 2 and 3, and the four-bar linkage 6 ensures that the upper part 4 remains parallel to the base part 2 at all times.

A lower paper holding member 8 is attached to the base part 2, and an upper paper holding member 10 is attached to the upper part 4, in order to hold the sheet of paper which is to be folded. The lower paper holding member 8 is formed as a flat, elongate, rigid strip extending across, and parallel with, the upper surface of the base part 2. One end of the lower paper holding member 8 is connected to the upper surface of the base part 2 at the side of the base part 2 which is nearest the four-bar linkage 6. Similarly, the upper paper holding member 10 is formed as a flat, elongate, rigid strip extending across, and parallel with, the lower surface of the upper part 4. One end of the upper paper holding member is connected to the lower surface of the upper part 4 at the side of the upper part 4 which is nearest the four-bar linkage 6.

Figure 2:
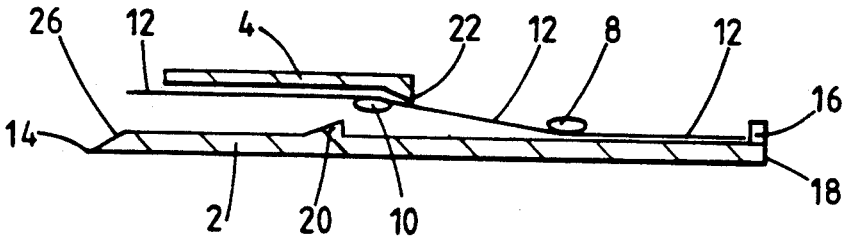
FIG. 2 is a sectional view along line II—II of FIG. 2, showing the folding device in a loading position.

In operation, the folding device is moved to its first position, shown in FIG. 2, and a sheet of paper 12 is inserted between the upper part 4 and the base part 2 from the front end 14 of the base part 2, until the sheet reaches the position shown in FIG. 2. As shown in FIG. 2, the sheet 12 first passes between the upper paper holding member 10 and the upper part 4, and then passes between the lower paper holding member 8 and the base part 2, until the end of the sheet 12 abuts against the stop 16 at the rear end 18 of the base part 2. A short ramp 20 is connected to, and extends across, the base part 2 in order to guide the sheet 12 upwards so that it passes between the upper paper holding member 10 and the upper part 4. In addition, a further ramp 22 extends along the lower side of the rear edge 24 of the upper part 4 in order to guide the sheet 12 downwards so that it passes between the lower paper holding member 8 and the base part 2. The base part 2 is also formed with an upwardly sloping front edge 26 adapted to guide the sheet 12 between the upper part 4 and base part 2.

Figure 3:
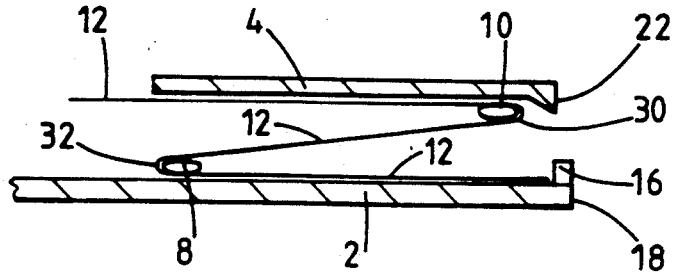
FIG. 3 is a sectional view along the line II—II of FIG. 1, showing the position of the folding device after a folding operation.

Once the sheet 12 is in the position shown in FIG. 2, the folding device may be moved to its second position, shown in FIG. 3, by operating a handle 28 attached to one of the bars of the four-bar linkage 6. As the folding device is moved to its second position, the sheet 12 becomes folded around the lower and upper paper holding members 8 and 10. Because the holding members 8 and 10 are formed as flat strips, the sheet 12 becomes sharply and neatly folded along two lines 30 and 32 so as to form a zig-zag shape.

Once the sheet 12 has been folded, it may be slid out from the side of a folding device opposite the four-bar linkage 6, and then placed into an appropriate envelope.

In further, non-illustrated, embodiments of the invention, the bars of the four-bar linkage 6 may be of adjustable length, and the lower and upper paper holding members 8 and 10 may be adapted to clamp the sheet to the base part 2 and upper part 4 respectively. Furthermore, the lower and upper paper holding members 8 and 10 may be telescopic, and/or may be pivotally connected to the base part 2 and upper part 4 respectively.

I claim:

1. A folding device for folding a sheet of thin material, comprising a base part having mounted thereon a first elongate rigid paper holding member which extends across, and is parallel with, an upper surface of the base part to define between the holding member and the base part a first elongate slot to receive a first portion of a sheet to be folded, an upper part having mounted thereon a second elongate rigid paper holding member which is parallel to the first holding member and extends across, and is parallel with, a lower surface of the upper part to define between the second holding member and the upper part a second elongate slot to receive a second portion of the sheet to be folded, a pivoted linkage comprising two parallel bars connecting the upper part to the base part to permit the upper part to be swung relatively to the base part through substantially 180° from a first position, where the second holding member lies adjacent the base part and is spaced from the first holding member on one side thereof, to a second position where the second holding member again lies adjacent the base part and is then spaced from the first holding member on the opposite side thereof.

2. A folding device according to claim 1, wherein a first guide ramp is provided on the base part, in a position which is adjacent to the second holding member when the upper part is in said first position relative to the base part, to guide a sheet to be folded towards the elongate slot between the second holding member and the upper part.

3. A folding device according to claim 1 wherein a second guide ramp is provided on said lower surface of the upper part, in a position which is between the second holding member and the first holding member when the upper part is in the aforesaid first position relative to the base part, to guide the sheet to be folded towards the elongate slot between the first holding member and the base part.

4. A folding device according to claim 1, wherein the elongate holding members are rigid and are connected at only one end thereof to the base part and upper part respectively.

5. A folding device according to claim 1, wherein the elongate holding members are formed as flat, rigid strips extending across, and parallel with, the upper surface of the base part and the lower surface of the upper part respectively.

6. A folding device according to claim 1, wherein the base part comprises at least one stop to enable the sheet to be correctly positioned relative to the holding members before the sheet is folded.

7. A folding device according to claim 1, wherein a handle is attached to one of the bars of the pivoted linkage to enable said swinging movement of the upper part relative to the base part to be effected manually.

* * * * *